US005573141A

United States Patent [19]

Chen

[11] Patent Number: 5,573,141

[45] Date of Patent: Nov. 12, 1996

[54] DOUBLE WALLED COOLING MUG

[76] Inventor: Wen-Yen Chen, P.O. Box 90, Tainan, Taiwan, 704

[21] Appl. No.: 527,812

[22] Filed: Sep. 11, 1995

[51] Int. Cl.[6] ..... B65D 23/02; B65D 8/06; B65D 8/22; F25D 3/08

[52] U.S. Cl. ..... 62/457.3; 220/613; 220/739; 220/408

[58] Field of Search ..... 220/408, 460, 220/903, 714, 715, 613, 739; 62/457.3, 457.4; 229/403

[56] References Cited

U.S. PATENT DOCUMENTS

| | | | |
|---|---|---|---|
| 2,832,493 | 4/1958 | Murphy | 220/903 X |
| 3,360,957 | 1/1968 | Paquin | 62/457.3 |
| 3,766,975 | 10/1973 | Todd | 62/457.3 X |
| 4,212,408 | 7/1980 | Valenzona | 220/715 X |
| 4,357,809 | 11/1982 | Held et al. | 62/457.4 |
| 4,485,636 | 12/1984 | Hilado | 62/457.3 X |
| 4,618,066 | 10/1986 | Vail | 229/403 X |
| 4,782,670 | 11/1988 | Long et al. | 62/457.4 |
| 4,886,181 | 12/1989 | Haines | 220/613 X |
| 5,067,329 | 11/1991 | Tomlinson | 62/457.4 |

*Primary Examiner*—Allan N. Shoap
*Assistant Examiner*—Niki M. Kopsidas

[57] ABSTRACT

A mug consists of an outer body made of plastics and an inner body made of a metal. The outer body has a sloped circumferential wall defining a hollow cavity. A bottom plate is fixed with a bottom end of the outer body, having a plurality of seats spaced apart on an upper surface for supporting the bottom of the inner body. An anti-leak gasket engages with an annular groove provided around an upper opening of the inner body, which has its upper edge closely contacting with an annular groove of the outer body after placed in the outer body supported by the seats on the bottom plate securely.

2 Claims, 3 Drawing Sheets

DOUBLE WALLED COOLING MUG

BACKGROUND OF THE INVENTION

This invention concerns a mug, particularly one with a cooling function.

Nowadays, common mugs used are for containing drink therein, having no structure for keeping it cool. So drink contained therein may become warm after a period of time, warmed up by the room temperature in case of not drunk in time, even if the drink is cool when poured in the mug.

Another mug known is structured to have an outer body and an inner body formed of plastics, and a refrigerant is filled in a hollow chamber formed between the outer body and the inner body. Then drink poured in the inner body may be kept cool by the refrigerant. As plastics is slow to transmit temperature, a user has to wait for some time to let the drink cool down. In addition, the outer and the inner body made of plastics are apt to crack or break in case of freezing to a great extend by the refrigerant, permitting the refrigerant to seep into the inner body, and if worse, without perceived.

SUMMARY OF THE INVENTION

This invention has been devised to offer a kind of mug with a cooling function to keep drink contained therein cool for a long period of time.

A special feature of the present invention is an outer body made of plastics, an inner body made of a metal and a chamber formed between the outer body and the inner body for containing a refrigerant so that drink contained in the inner body may be cooled by the refrigerant. And the inner body has an annular groove for an anti-leak gasket to engage, and the outer body has an annular groove for an upper edge of the inner body to engage. And a bottom plate is adhered with the open bottom end of the outer body by means of supersonic welding and has a plurality of seats on its upper surface for supporting the bottom of the inner body so that the inner body may not fall out of the outer body, kept secured.

BRIEF DESCRIPTION OF DRAWINGS

The invention will be better understood by reference to the accompanying drawings, wherein.

DESCRIPTION OF THE PREFERRED EMBODIMENT

Figure 1:
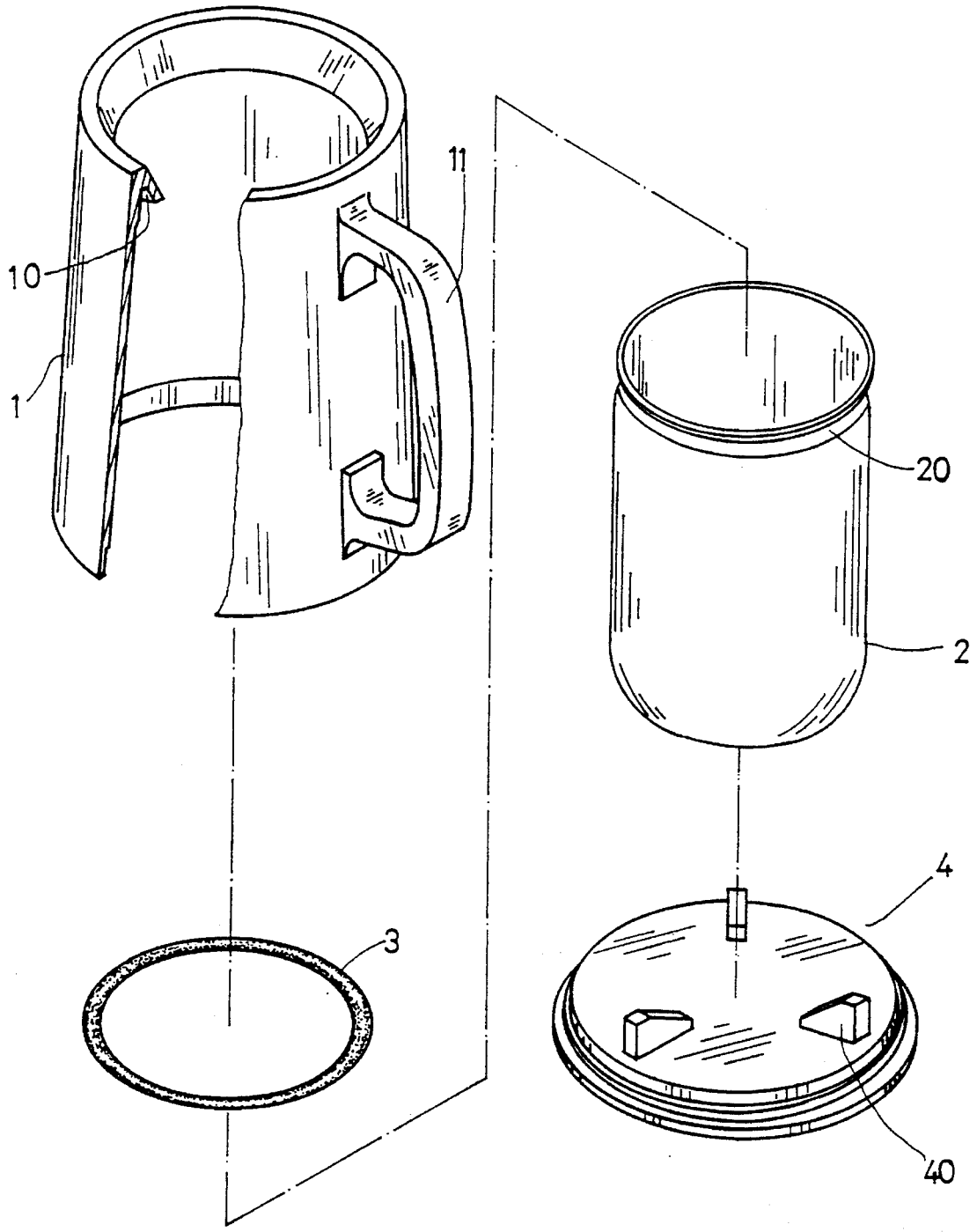
FIG. 1 is an exploded perspective view of a mug in the present invention.
Figure 2:
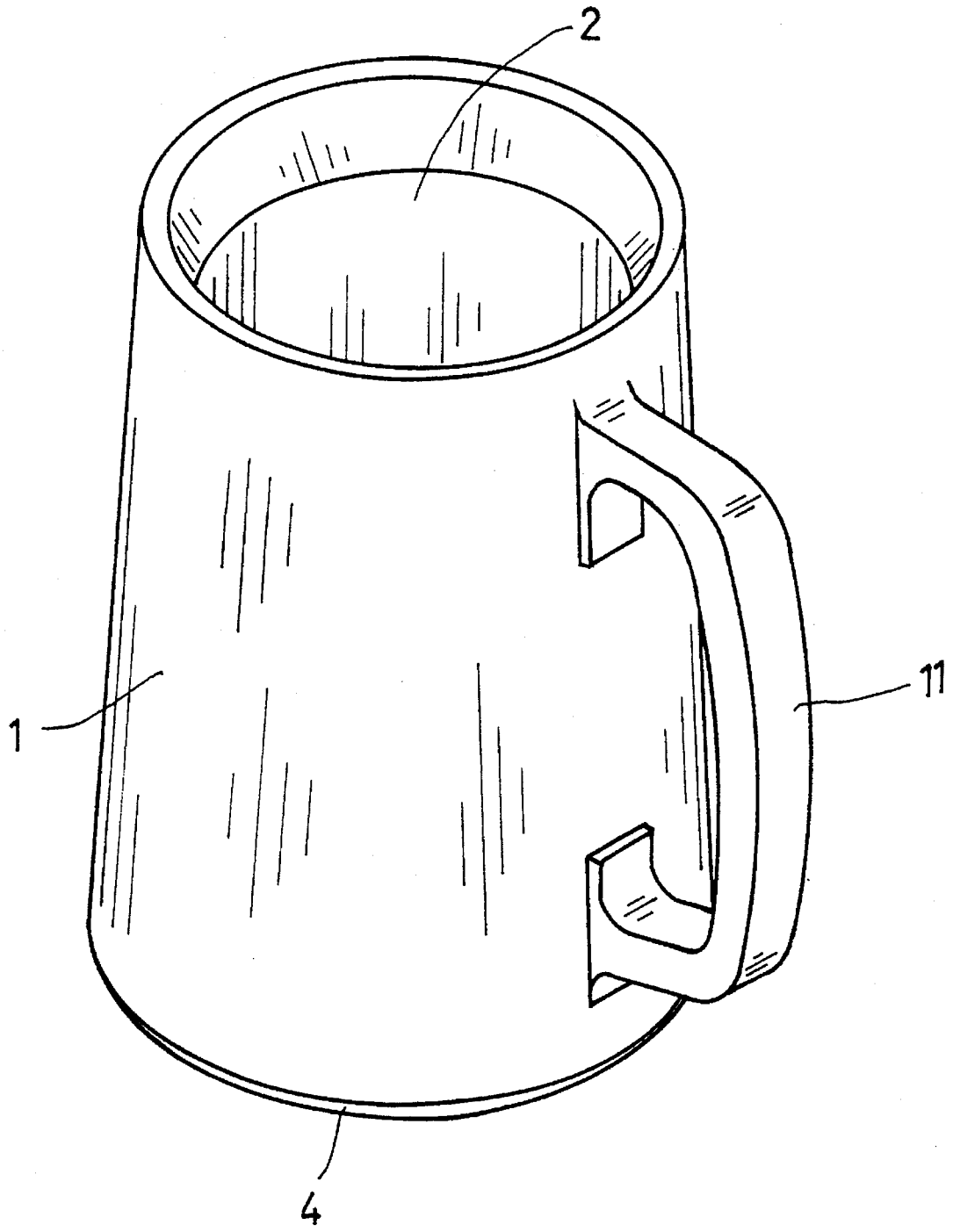
FIG. 2 is a perspective view of the mug in the present invention.

A preferred embodiment of a mug in the present invention, as shown in FIG. 1, includes an outer body 1, an inner body 2, an anti-leak gasket 3, and a bottom plate 4 combined together.

The outer body 1 is made of plastics, having a sloped circumferential wall widening downward and defining a hollow cavity, an upper opening, a bottom opening, an annular groove 10 formed around the upper opening, and a handle 11 fixed on an outer surface of the circumferential sloped wall.

The inner body 2 is made of a metal, being contained in the hollow cavity of the outer body 1, having a cylindrical shape with a closed bottom and an upper opening, and an annular groove 20 around the upper opening.

The anti-leak gasket 3 is fitted around the annular groove 20 of the inner body 2.

The bottom plate 4 is adhered with the bottom of the outer body 1 by means of supersonic welding, having three bottom seats 40 of a shape spaced radially on an upper surface for supporting the bottom of the inner body 2 so as to secure the inner body 2 in the hollow cavity of the outer body without possibility of falling out thereof.

Figure 3:
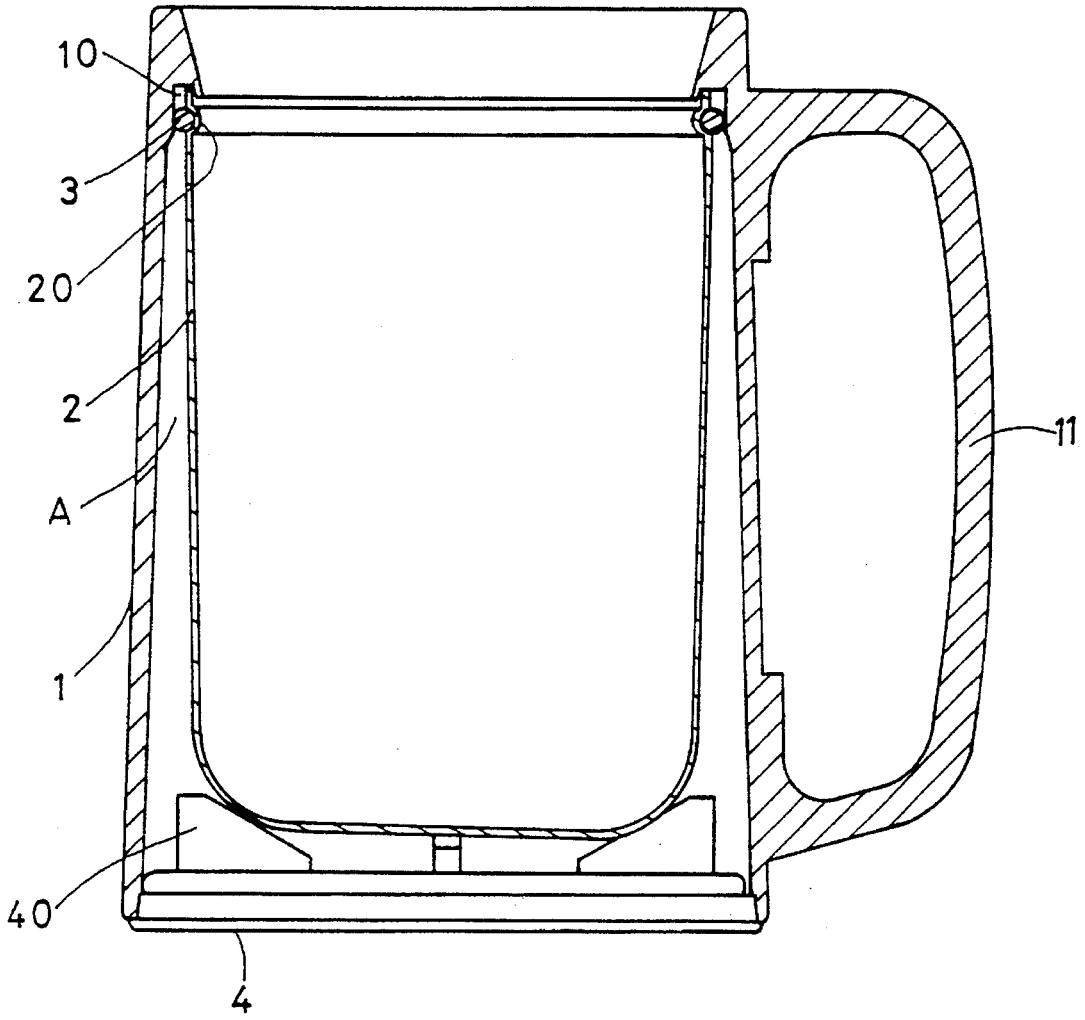
FIG. 3 is a cross-sectional view of the mug in the present invention.

In assembling, referring to FIGS. 3 and 4, the anti-leak gasket 3 is at first fitted around the annular groove 20 of the inner body 2, and next, the inner body 2 is placed in the hollow cavity of the outer body 1, with the upper circumferential edge engaging the annular groove 10 of the outer body 1, and with the anti-leak gasket 3 closely contacting with the inner surface of the outer body 1. Consequently, an annular vertical chamber A is formed between the outer body 1 and the inner body 2, having dimensions gradually becoming wider downward. Then a refrigerant B is poured in the chamber A, being prevented from flowing in the inner body 2 by the anti-leak gasket 3. Lastly, the bottom plate 4 is adhered with the bottom end of the outer body 1 by means of supersonic welding, with the three seats 40 supporting the bottom of the inner body 2 and letting the upper edge closely contacting with the annular groove 10 of the outer body 1 to prevent the inner body 2 from falling out of the outer body 1.

In using, a refreshment or drink is poured in the inner body 2, able to be cooled by the refrigerant B in the chamber A. Then ice may be produced in the chamber A, and the thickness of the ice becomes more and more downward to keep the lower portion of the refreshment cooler. As the inner body 2 is made of metal, it cannot crack or break owning to expansion caused by the freezing. In addition, what is contained in the inner body 2 can be quickly cooled by fast heat transmitting function of the material, metal, of the inner body.

This invention is considered to have the following advantages.

1. The drink contained in the inner body 2 can be kept cool for a long period of time by the refrigerant, after the refrigerant is filled in the chamber A.

2. The anti-leak gasket 3 can prevent the refrigerant from flowing in the inner body 2.

3. The inner body can be supported by the seats 40, preventing the inner body 2 from fallen off the outer body 1, and compensating height difference between the inner body 2 and the outer body 1.

4. The inner body 2 never crack or break during freezing, and besides, able to permit drink contained therein cool quickly owing to its material, metal.

5. Its components are simple, and easy to assemble together.

While the preferred embodiment of the invention has been described above, it will be recognized and understood that various modifications may be made therein, and the appended claims are intended to cover all such modifications which may fall within the spirit and scope of the invention.

What is claimed is:

1. A mug comprising:

an outer body made of plastic, having a sloped cylindrical wall with an inner surface defining a hollow cavity, an upper opening, a bottom opening, a first annular groove extending around said upper opening the first annular groove opening toward said bottom opening, and a handle extending from an outer surface of said cylindrical wall;

an inner body configured to receive a liquid and made of metal located in said hollow cavity of said outer body, the inner body having a second annular groove around an upper circumferential edge;

an anti-leak gasket in said annular groove of said inner body;

a refrigerant material located in a chamber between said outer body and said inner body;

a bottom plate adhered to a bottom end of said outer body so as to cover said bottom opening, the bottom plate having a plurality of spaced apart seats on an upper surface thereof in contact with a bottom of said inner body so that the upper edge of said inner body engages said first annular groove of said outer body, such that said gasket seals against the inner surface of said outer body and the second annular groove in the inner body, whereby said refrigerant cools a liquid poured in said inner body quickly because of fast heat transmitting function of the metal material of the inner body.

2. The mug as claimed in claim 1, wherein said sloped cylindrical wall widens gradually downward from the upper opening to the bottom opening so that said chamber gradually widens downwardly.

* * * * *